US007019705B2

(12) United States Patent
Pfletschinger et al.

(10) Patent No.: US 7,019,705 B2
(45) Date of Patent: Mar. 28, 2006

(54) WIDE BAND SLOT CAVITY ANTENNA

(75) Inventors: Markus Pfletschinger, Eningen (DE); Martin Kuhn, Stuttgart (DE)

(73) Assignee: Hirschmann Electronics GmbH & Co., KG, Neckartenzlingen (DE)

( * ) Notice: Subject to any disclaimer, the term of this patent is extended or adjusted under 35 U.S.C. 154(b) by 22 days.

(21) Appl. No.: 10/467,658

(22) PCT Filed: Nov. 13, 2002

(86) PCT No.: PCT/EP02/12692

§ 371 (c)(1),
(2), (4) Date: Dec. 29, 2003

(87) PCT Pub. No.: WO03/052873

PCT Pub. Date: Jun. 26, 2003

(65) Prior Publication Data

US 2004/0104858 A1 Jun. 3, 2004

(30) Foreign Application Priority Data

Dec. 15, 2001 (DE) ..... 101 61 722

(51) Int. Cl.
*H01Q 13/10* (2006.01)

(52) U.S. Cl. ..... 343/770; 343/767

(58) Field of Classification Search ..... 343/767, 343/770, 700 MS, 846, 713
See application file for complete search history.

(56) References Cited

U.S. PATENT DOCUMENTS

| | | | | |
|---|---|---|---|---|
| 4,132,995 | A | 1/1979 | Monser | 343/767 |
| 4,425,549 | A | 1/1984 | Schwartz et al. | 329/161 |
| 4,843,403 | A | 6/1989 | Lalezari et al. | 343/767 |
| 4,873,529 | A | 10/1989 | Gibson | 343/700 MS |
| 5,182,570 | A | 1/1993 | Nysen et al. | 343/795 |
| 5,428,364 | A | 6/1995 | Lee | 343/767 |
| 5,714,961 | A * | 2/1998 | Kot et al. | 343/679 |
| 5,900,843 | A | 5/1999 | Lee | 343/767 |
| 6,008,770 | A | 12/1999 | Sugawara | 343/767 |
| 2001/0048391 | A1 | 12/2001 | Annamaa et al. | 343/700 MS |

FOREIGN PATENT DOCUMENTS

| | | |
|---|---|---|
| DE | 42 20 654 | 1/1993 |
| DE | 199 22 699 | 12/2000 |
| DE | 199 28 213 C | 5/2001 |
| EP | 0 301 216 | 2/1989 |
| EP | 0 323 664 A | 7/1989 |

* cited by examiner

*Primary Examiner*—Hoang V. Nguyen
(74) *Attorney, Agent, or Firm*—Fulbright & Jaworski, LLP

(57) ABSTRACT

The present invention relates to an antenna (1), especially a vehicle mounted antenna for use in mobile telephony. In order to achieve a compact, especially flat and short construction for the antenna, as configured, a radiating open hollow cavity resonator with a specially designated set of wide band slots (7,8) is arranged on a nonconductive board with multiple conductive areas (4, 5, and 6) situated about the slots (7,8).

12 Claims, 2 Drawing Sheets

WIDE BAND SLOT CAVITY ANTENNA

BACKGROUND OF THE INVENTION

1. Field of the Invention

The present invention relates to an antenna, especially an antenna for mobile telephony use with a motor vehicle, and more particularly an antenna including multiple conductive areas, such as conductive panels, arranged in a coplanar fashion with interspersed slots.

2. Description of the Related Technology

DE 199 22 699 A1 discloses an antenna, preferably a motor vehicle antenna for mobile telephony. In this antenna there are vertical radiators for use as radiating structures which are located on a ground surface and are interconnected via an impedance transformation line. As a result of tuning, especially by the adjustment of the length of the vertical radiators, and the impedance transformation line for the intended frequency range, for example in the mobile telephony range from 0.8 to 2.2 GHz, the resulting known antenna has accordingly determined length and height dimensions. Since this prior known antenna often is integrated underneath a rear window of a motor vehicle, and due to its determined geometrical dimensions, it requires a large installation space which is either not available or it reduces the amount of interior volume of the motor vehicle in an undesirable manner. Another disadvantage is that a coaxial cable for signal transmission is soldered directly to the ground surface, the inner lead of the coaxial cable being connected to the impedance transformation line. This yields a complex structure that has the special disadvantage that before installation of the antenna there is a cable tail which poses problems in handling the prefabricated antennas before their installation.

SUMMARY OF THE INVENTION

An object of the invention is to make available an antenna, especially an antenna for use with a motor vehicle for mobile telephony that avoids the above mentioned disadvantages.

For the antenna according to the present invention, the radiating structures are provided by a conductive area that is open on both sides and which is slit lengthwise such that the arrangement can be excited to radiate in several frequency ranges. These arrangements make it possible for the antenna of the present invention to have a compact structure with the same capabilities as the prior known antennae, but with the antenna of the present invention having a much shorter (by roughly one half) and a flatter physical size. Thus the installation spaces under rear windows or on roof flanges of motor vehicles can be much better and more efficiently used. Depending on the extent of the frequency ranges or depending on the frequencies which are to be sent or received the antenna lengths for antennae according to the present invention correspond roughly to one third of the wavelength of the lowest frequency.

As an aspect of the invention the conductive area that is slit lengthwise can include a double kink, e.g., a pair of obtuse angles along an edge of a conductive area, in a partial area. The doubly kinked slot which has, for example, a funnel shape facilitates a very broad band and thus makes the radiator more accommodating relative to installation tolerances.

As an aspect of the present invention a lengthwise-slit between conductive areas forms a slot that tapers to a point.

Thus a vertical radiator capability is effectively provided from a flat structure for use over the required frequency range or ranges.

As another aspect of the present invention another or second slot that branches especially roughly from the middle of the first slot proceeds from the first slot which tapers to a point and separates the lengthwise-slit conductive areas from one another. Depending on the physical arrangements, especially the width and length of the bent second slot, the impedance of the antenna can be matched over wide ranges or also over additional ranges. For optimum impedance matching and also for optimum surface utilization, a leg of the bent second slot, which leg proceeds from the slot that tapers to a point, is shorter than the second slot area adjoining it.

As another aspect of the present invention the antenna conductive areas are shielded in the direction in which emission is not to take place by a housing body, especially a sheet of metal. This metal housing body prevents emission into the interior of the motor vehicle. Depending on the dimensions of the housing body which extends at least over the area of a board, but can also be larger or smaller, at least a significant reduction of emission into the interior of the motor vehicle is accomplished.

As another aspect of the present invention the lengthwise-slit conductive areas are located on a board as copper surfaces on the board. This structure on the one hand makes available an economical material arrangement for producing the effective vertical radiators of the antenna. On the other hand, it is possible by known methods (for example, etching processes) to provide the copper areas on the board, while at least one slot, or alternatively two slots, can be produced by etching away corresponding copper areas. Based on this process it is possible to arrange the shape of the areas as well as the shape of the slots as wide, flat areas.

As another aspect of the present invention the branching slot is made such that a direct current short circuit does not occur at the base of the antenna. For this reason, before its installation the antenna can be electrically checked for serviceability and for faults. By preventing a direct current short circuit, only one simple test resistor need be connected in parallel at the feed point. A coupling capacitor which is necessary for conventional slotted radiators can be omitted. This further simplifies the structure and reduces costs.

As another aspect of the present invention, there is a contact partner, e.g., a plug, mounted at the base of the antenna on the board. In this way, during production of the antenna a contact partner already is provided on the board without the necessity of a cable being provided at that time. For testing the antenna, such a cable can be connected temporarily via the contact partner. After the test the cable can be removed again so that transport and storage of the antenna is simplified up to its final installation. Only with or after installation of the antenna in a vehicle does the corresponding cabling need to take place.

BRIEF DESCRIPTION OF THE DRAWINGS

An embodiment for the antenna, according to the present invention, and its installation are described and explained below using the shown figures. The present invention, however, is not limited to the indicated embodiments.

DETAILED DESCRIPTION

Figure 1:
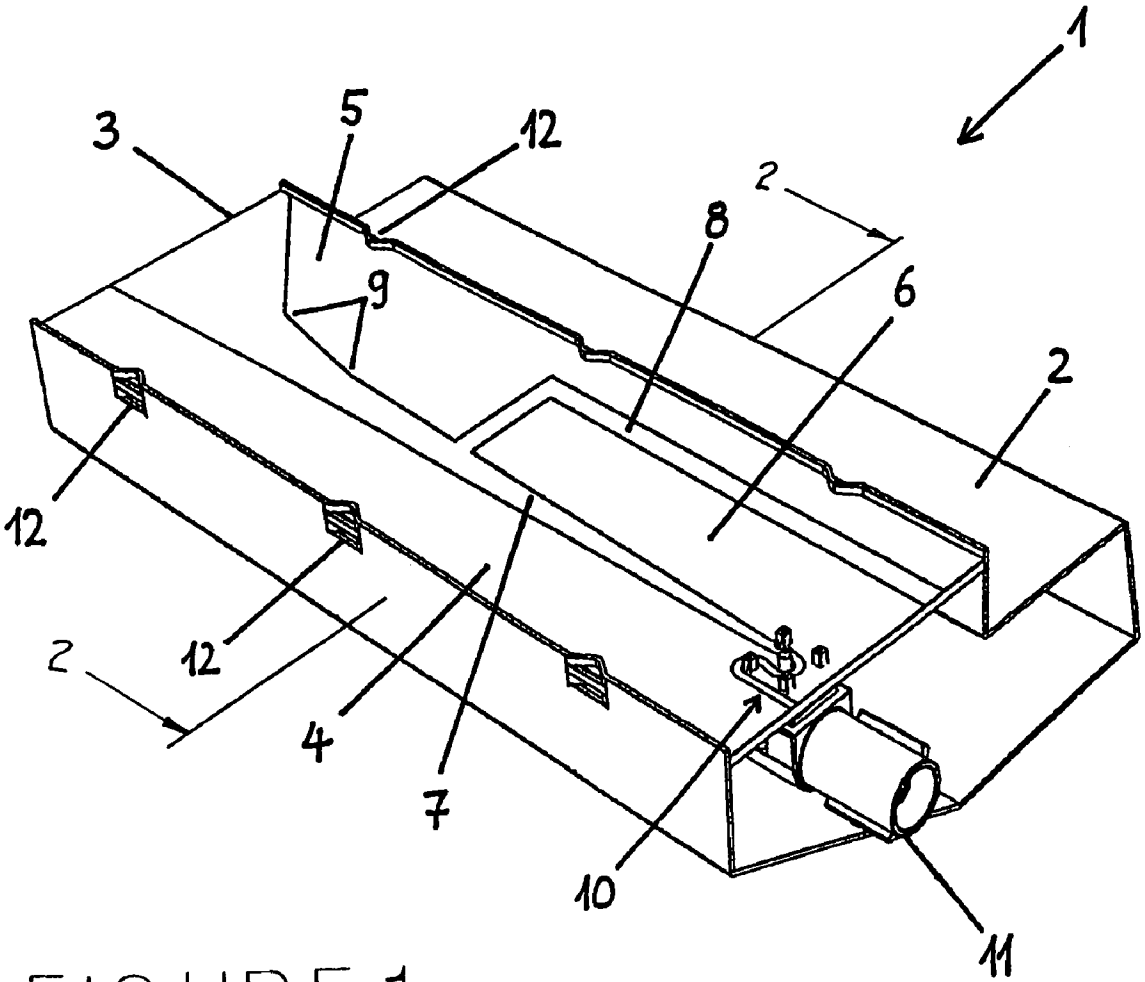
FIG. 1 shows a three-dimensional perspective view of a prefabricated antenna according to the present invention; and, FIG. 2 shows a sectional view of the antenna as shown in FIG. 1 at an installation site.

FIG. 1 shows an antenna 1 according to the present invention for receiving and sending high frequency signals, especially in the mobile telephony domains AMPS, GSM 900/18000, PCS, UMTS and the like. The shown antenna 1 is especially usable as a motor vehicle mounted antenna, or for other applications, such as static applications also are achievable.

The antenna 1 has a metal housing body which consist of a multiply bent metal sheet 2. Such a bent metal sheet 2 is on the one hand desirable in reducing material costs, and on the other it easily and quickly can be produced. This use of multiply bent metal sheet 2 benefits production of the antenna 1. The corresponding bending of the metal sheet 2 yields two parallel legs spaced apart, with a board 3 located between them. In a conventional manner the board 3 has a base surface which consists of nonconductive material. On this base surface of the board 3 there are several conductive areas 4 to 6 which are produced, for example, by covering the later with conductive areas 4 to 6 and etching away intermediate areas. The areas which are etched away form at least one first slot 7 which is formed on one side by the shape of an edge of area 4 and on another side by the shapes of edges of areas 5 and 6. Furthermore, proceeding from this first slot 7 for matching the impedance of the antenna 1 there is a second slot 8 which in turn separates the two areas 5 and 6 from one another. If the second slot 8 is omitted, the two areas 5 and 6 form a continuous area, the second slot 8 extends roughly from the middle or median length of the first slot 7 at a right angle a short distance, then a longer length of the second slot 8 extends roughly parallel to the first slot 7.

In the embodiment of the antenna 1 which is shown in FIG. 1 the conductive area 5 includes double kinks 9. These double kinks 9 are obtuse angles, i.e., more than 90 degrees but less than 180 degrees, as measured from conductive area 5. At the base 10 of the antenna 1 there is a contact partner, especially a plug 11, to which a twin conductor cable, e.g., a coaxial cable, for feeding signals to and from the antenna 1 can be plugged. In order to be able to attach the board 3 to the housing body, especially the bent metal sheet 2, the legs of the metal sheet 2 which are spaced parallel to one another have several punched-bent areas 12, e.g., punched-bent attachment fasteners, by which the board 3 is attached to the housing base body. These punched-bent areas 12 have the advantage that they are simple to produce and thus the board 3 can be quickly attached to the housing body 2.

Figure 2:
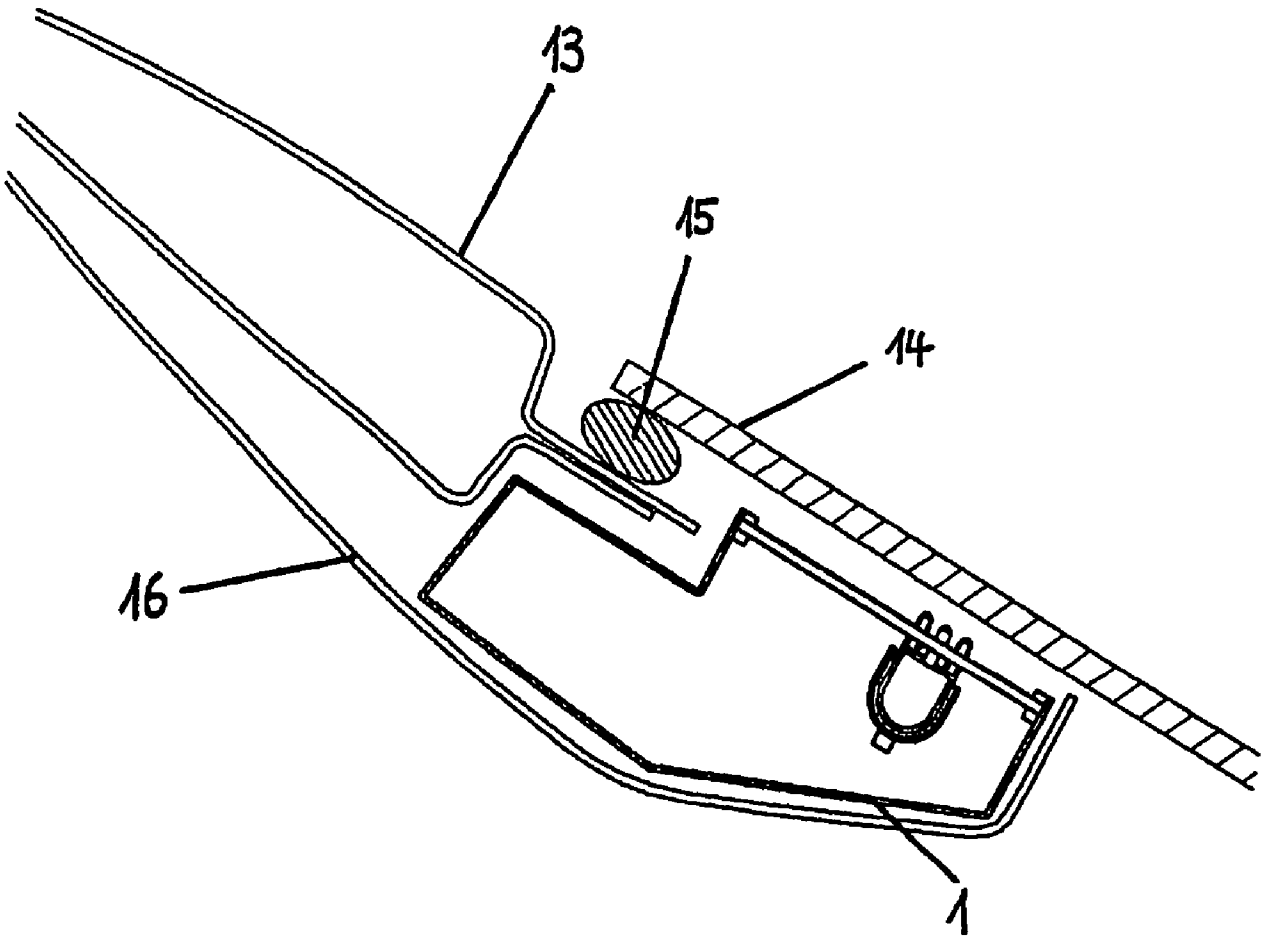

FIG. 2 shows the antenna 1, which is shown in a three-dimensional view in FIG. 1, in a sectional view taken from line 2—2 at an installation site. At an end area of a roof flange 13 of a vehicle which is not further shown a rear window 14 adjoins and is attached to the roof flange 13 by means of cement (cement bead 15). In the area between the window 14 and an inner lining 16 (head liner) is the installation site for the antenna 1 which can be kept especially flat as a result of the advantageous configuration of the antenna 1.

The antenna 1, especially a motor vehicle antenna for mobile telephony, is thus in summary made as a radiating open cavity resonator with a specially executed broadband slot in order to achieve a structure which is as compact, especially flat and short, as possible.

The invention claimed is:

1. An antenna for receiving and transmitting electromagnetic waves, said antenna comprising:

at least three electrically conductive panels supported so as to be coplanar;

each of said conductive panels having at least one edge disposed to be adjacent but not in contact with at least one edge of another of said conductive panels, and said edges of all of said conductive panels so disposed in distance as to form at least a first slot between said conductive panels so that electromagnetic waves can be received by and transmitted from the supported coplanar conductive panels and said at least first slot; and a first conductive panel of said at least three conductive panels having a first edge including at least two obtuse angles as measured from said first conductive panel, and said first edge forming a part of said at least first slot.

2. The antenna according to claim 1, further comprising a second slot formed between at least one second edge of said first conductive panel and at least one first edge of a second conductive panel, said first slot formed between said first edge of said first conductive panel, a second edge of said second conductive panel and an edge of a third conductive panel, said first edge of said first conductive panel including said at least two obtuse angles that are disposed to form a part of said first slot, and said second slot opens at one end into said first slot at a median length of said first slot.

3. An antenna for receiving and transmitting electromagnetic waves, said antenna comprising:

At least three electrically conductive panels supported so as to be coplanar;

each of said conductive panels having at least one edge disposed to be adjacent but not in contact with at least one edge of another of said conductive panels, and said edges of all of said conductive panels so disposed in distance as to form at least a first slot between said conductive panels so that electromagnetic waves can be received by and transmitted from the supported coplanar conductive panels and said at least first slot: and a first, second and third conductive panels of said at least three conductive panels, all of said first, second and third conductive panels having edges and being disposed to be coplanar and positioned at distances apart from each other to form said first slot so that said first slot decreases in width along a length of said first slot.

4. The antenna according to claim 3, further comprising a nonconductive board on which said conductive panels are supported to be coplanar.

5. The antenna according to claim 4 wherein all of said conductive panels are formed of copper.

6. The antenna according to claim 4, further comprising:

having each of said conductive panels have a first side and a second side with said edges disposed between said first and second sides, and all of said conductive panels being supported on said nonconductive board to be coplanar with all of said first sides facing in a first direction and all said second sides facing in a second direction; and, a metal housing body disposed to cover said second sides and said at least first slot, said metal housing body including at least two punched-bent attachment fasteners that are fixed to said nonconductive board.

7. The antenna according to claim 3, further comprising a second slot formed between at least one edge of said first conductive panel and at least one edge of said second conductive panel, said first slot formed between edges of said first and second conductive panels and said third conductive panel, and said second slot opens at one end into said first slot at a median length of said first slot.

8. An antenna for receiving and transmitting electromagnetic waves, said antenna comprising:

at least three electrically conductive panels supported so as to be coplanar;

each of said conductive panels having at least one edge disposed to be adjacent but not in contact with at least one edge of another of said conductive panels, and said edges of all of said conductive panels so disposed in distance as to form at least a first slot between said conductive panels so that electromagnetic waves can be received by and transmitted from the supported coplanar conductive panels and said at least first slot;

a first conductive panel of said at least three conductive panels having a first edge including at least two obtuse angles as measured from said first conductive panel, and said first edge forming a part of said at least first slot: and, a second slot formed between at least one edge of said first conductive panel and at least one edge of a second conductive panel, said first slot formed between edges of said first and second conductive panels and a third conductive panel, and said second slot opens at one end into said first slot at a median length of said first slot.

9. An antenna for receiving and transmitting electromagnetic waves, said antenna comprising:

at least three electrically conductive panels supported so as to be coplanar;

each of said conductive panels having at least one edge disposed to be adjacent but not in contact with at least one edge of another of said conductive panels, and said edges of all of said conductive panels so disposed in distance as to form at least a first slot between said conductive panels so that electromagnetic waves can be received by and transmitted from the supported coplanar conductive panels and said at least first slot;

having each of said conductive panels have a first side and a second side with said edges disposed between said first and second sides, and all of said conductive panels being supported to be coplanar with all of said first sides facing in a first direction and all of said second sides facing in a second direction; and, a metal housing body disposed to cover said second sides and said at least first slot.

10. The antenna according to claim 9, wherein said metal housing is formed from a bent metal sheet.

11. An antenna for receiving and transmitting electromagnetic comprising:

at least three electrically conductive panels supported so as to be coplanar;

each of said conductive panels having at least one edge disposed to be adjacent but not in a contact with at least one edge of another of said conductive panels and said edges of all of said conductive panels so disposed in distance as to form at least a first slot between said conductive panels so that electromagnetic waves can be received by and transmitted from the supported coplanar conductive panels and said at least first slot; and a plug disposed for interconnecting two of said conductive panels to a twin conductor cable to transmit signals to and from said antenna.

12. The antenna according to claim 11, wherein said plug is disposed adjacent said first slot where the width of said first slot is most decreased.

* * * * *